US012150540B2

(12) United States Patent
Sarlin

(10) Patent No.: US 12,150,540 B2
(45) Date of Patent: Nov. 26, 2024

(54) PERSONAL LOAD BEARING HARNESS SYSTEM FOR DEFENSE TRAINING OR OPERATIONAL ENVIRONMENTS

(71) Applicant: BUZZWORKS THINK TANK PTY LTD, Brisbane (AU)

(72) Inventor: Shane Sarlin, Brisbane (AU)

(73) Assignee: Buzzworks Think Tank PTY LTD, Ashgrove (AU)

( * ) Notice: Subject to any disclaimer, the term of this patent is extended or adjusted under 35 U.S.C. 154(b) by 0 days.

(21) Appl. No.: 18/564,604

(22) PCT Filed: May 30, 2022

(86) PCT No.: PCT/AU2022/050520
§ 371 (c)(1),
(2) Date: Nov. 27, 2023

(87) PCT Pub. No.: WO2022/251900
PCT Pub. Date: Dec. 8, 2022

(65) Prior Publication Data

US 2024/0251933 A1 Aug. 1, 2024

(30) Foreign Application Priority Data

May 31, 2021 (AU) ..... 2021901628

(51) Int. Cl.
*A45F 3/14* (2006.01)

(52) U.S. Cl.
CPC ..... *A45F 3/14* (2013.01); *A45F 2003/146* (2013.01)

(58) Field of Classification Search
CPC ..... A45F 3/14
USPC ..... 224/183
See application file for complete search history.

(56) References Cited

U.S. PATENT DOCUMENTS 7,240,404 B2 * 7/2007 Flossner ..... A41D 13/0012 224/675
7,644,449 B2 * 1/2010 Hellweg ..... A45F 5/02 2/102
7,963,427 B2 * 6/2011 Calkin ..... A41D 13/0012 224/675

(Continued)

*Primary Examiner* — Nathan J Newhouse
*Assistant Examiner* — Lester L Vanterpool
(74) *Attorney, Agent, or Firm* — Rodney J. Fuller; BOOTH UDALL FULLER, PLC

(57) ABSTRACT

A MOLLE system compatible garment has a lightweight attachment structure of horizontal bands connected by vertical bands and supports attachment of utility pouches woven onto this structure with vertical bands affixed at top of each pouch and secured at the bottom. This system has differently sized mono-layer load bearing panels cut to define holes delimiting vertical structural columns and vertical lightweight columns with horizontal bands which together present attachment points that correspond to those of a PALS webbing system. The system has mono-layer adaptor panels cut to define holes delimiting single vertical structural columns mounting different military standard connectors. The load bearing panels when overlaid with universal connector adaptor panels are secured by the weaving of the attached utility pouches' vertical bands to present a complete equipment carrying platform compatible with MOLLE system load carriage equipment.

15 Claims, 4 Drawing Sheets

(56) References Cited

U.S. PATENT DOCUMENTS

| | | | | |
|---|---|---|---|---|
| 8,002,159 | B2 * | 8/2011 | Cragg | A45F 5/02 224/675 |
| 8,079,503 | B1 * | 12/2011 | Yeates | A45C 7/0086 224/268 |
| 9,144,255 | B1 * | 9/2015 | Perciballi | A41D 27/00 |
| 9,486,058 | B1 * | 11/2016 | Moreau | A41D 1/04 |
| 9,565,922 | B2 * | 2/2017 | Cole | A45F 5/021 |
| 9,664,481 | B2 | 5/2017 | Alcantra et al. | |
| 9,780,344 | B2 * | 10/2017 | Thiel | H01M 50/548 |
| 9,974,379 | B2 * | 5/2018 | Cole | A44B 18/00 |
| D820,003 | S * | 6/2018 | Capdepon | D6/553 |
| 10,143,294 | B1 * | 12/2018 | Matson | A45F 5/02 |
| 10,159,328 | B1 * | 12/2018 | Hilliard | A45F 5/02 |
| 10,264,874 | B2 * | 4/2019 | Becker | A45F 3/14 |
| D880,778 | S * | 4/2020 | Martinez | D2/750 |
| 10,765,196 | B1 | 9/2020 | Thompson | |
| 10,863,817 | B2 | 12/2020 | Yeates et al. | |
| 2009/0014602 | A1 * | 1/2009 | Frost | B60R 7/08 248/100 |
| 2010/0025560 | A1 * | 2/2010 | Beck | A45F 5/02 248/558 |
| 2012/0180184 | A1 * | 7/2012 | Crye | A45F 5/02 2/69 |
| 2014/0091124 | A1 | 4/2014 | Hexels | |
| 2015/0189977 | A1 * | 7/2015 | Thompson | A45F 5/02 24/3.7 |
| 2016/0029777 | A1 * | 2/2016 | Gadams | F42B 39/02 224/222 |
| 2017/0307335 | A1 * | 10/2017 | Skifstad | F41C 33/041 |
| 2020/0000212 | A1 * | 1/2020 | LeMarbe | A45F 3/14 |

* cited by examiner

PERSONAL LOAD BEARING HARNESS SYSTEM FOR DEFENSE TRAINING OR OPERATIONAL ENVIRONMENTS

CROSS-REFERENCE TO RELATED APPLICATIONS

This application is the U.S. National Stage of International Patent Application No. PCT/AU2022/050520, filed on May 30, 2022, which claims the benefit of and priority to Australia Patent Application No. 2021901628, filed on May 31, 2021, the contents of each of which are hereby incorporated by reference in their entireties.

FIELD OF THE INVENTION

The present disclosure relates to improvements in personal carriage equipment designed to support heavy items in a flexible manner to facilitate manual traversal of difficult terrains by a user.

BACKGROUND OF THE INVENTION

In certain environments, such as a defensive or combat environment, the flexibility and weight of personal wearable equipment becomes important, particularly if a user or wearer of such equipment, such as a soldier, must traverse difficult terrain under at times, extreme weather conditions. Borrowing from a combat situation, to be in an optimal combat readiness, mentally and physically, the soldier needs to conserve energy over the course of a long march.

Conventional devices are not optimally designed in that they add significant weight to the overall load bearing system, are not adaptable to suit wearers of different body sizes, are not adaptable to suit wearing on different body parts, are not adaptable to fit more or less pouches, and/or are not interoperable with load carriage equipment of different opening configurations. Accordingly, there exists a need to provide an improved harness system with the flexibility to fit different body sizes, different body parts, more or less pouches and various opening configurations, without adding significant additional weight to the system.

The present disclosure seeks to lessen one or more of these problems by providing a platform or system which allows one or more load bearing panels to be connected by one or more adaptor panels to change the size and configuration of the load bearing system, with one or both of the load bearing panels and the adaptor panels including void space and openings that are interoperable with the vertical bands of load carriage equipment to minimise the weight of the system.

SUMMARY

The present disclosure provides for a personal mobile load bearing harness system for use in a defense training or operational environment. The system includes a substantially non-deformable load-bearing panel. The bearing panel has an outer perimeter defining a length and a width. The bearing panel includes a plurality of first harness band receiving apertures having a length and a width, and a plurality of second harness band receiving apertures, each of the second harness band receiving apertures having a length and a width greater than the length and width of the first harness receiving apertures, the lengths of the first and the second harness band receiving apertures being generally parallel to the length of the bearing panel. At least one of the first apertures is positioned between the edge and one of the second apertures, another of the first apertures being positioned between the edge and one of the second apertures so that one or more of the second apertures are positioned in a central region of the bearing panel and are configured to accommodate greater vertical and lateral movement of a harness band inserted through the first and the second apertures compared to vertical and lateral movement of the harness band inserted through only the first apertures.

It is to be understood that both the foregoing general description and the following detailed description are exemplary and explanatory only and are not restrictive of the invention, as claimed. In the present specification and claims, the word "comprising" and its derivatives including "comprises" and "comprise" include each of the stated integers, but does not exclude the inclusion of one or more further integers.

It will be appreciated that reference herein to "preferred" or "preferably" is intended as exemplary only. The claims as filed and attached with this specification are hereby incorporated by reference into the text of the present description.

The accompanying drawings, which are incorporated in and constitute a part of this specification, illustrate several embodiments of the invention and together with the description, serve to explain the principles of the invention.

DETAILED DESCRIPTION OF THE DRAWINGS

Reference will now be made in detail to the present preferred embodiments of the disclosure, examples of which are illustrated in the accompanying drawings.

Figure 1:
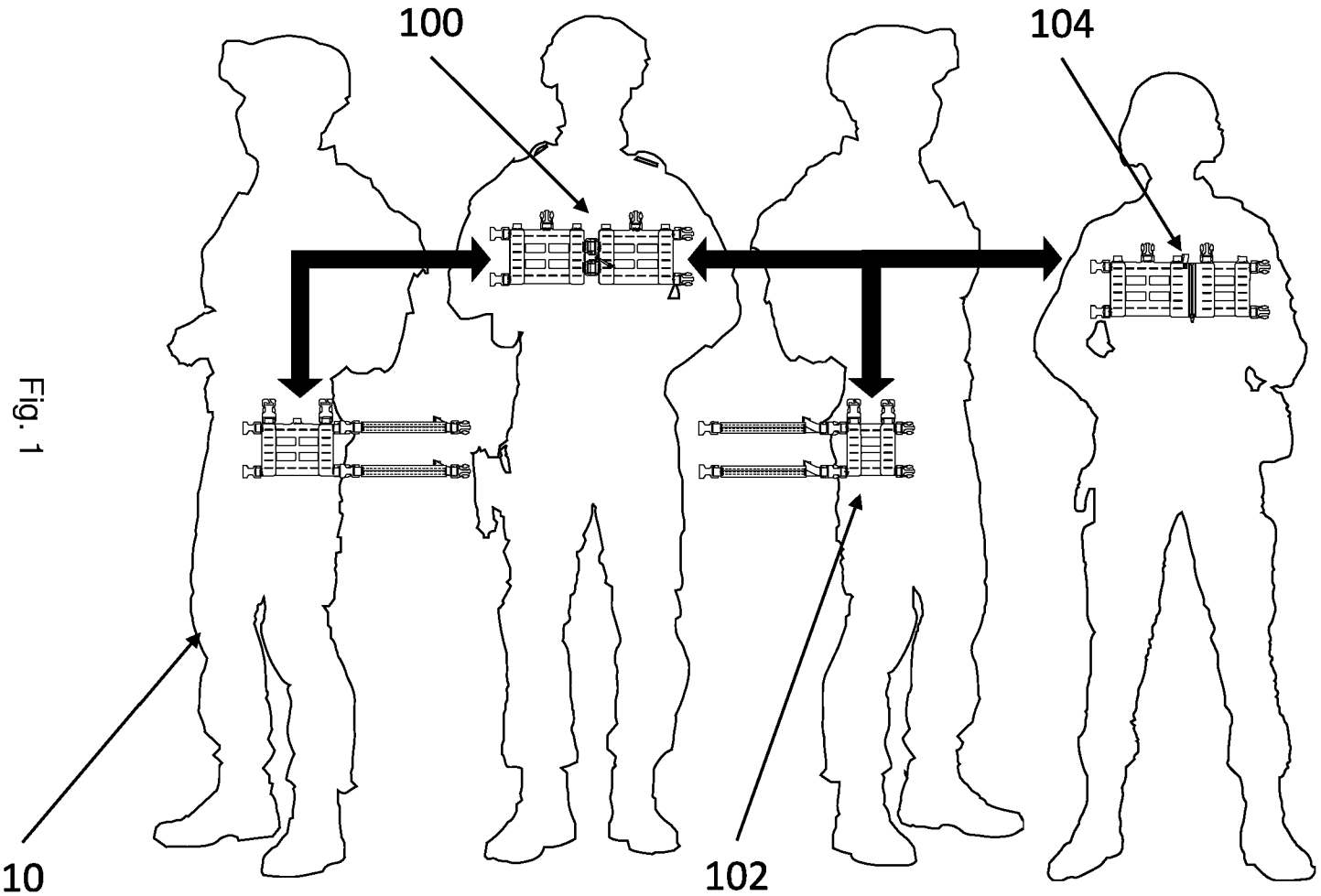
FIG. 1 shows the load bearing platform and system using multiple combinations of load bearing panels of different sizes and adaptor panels with different fasteners to fit user anthropometry, locations and user role and/or load carriage.

FIG. 1 shows a load bearing platform or harness system 100 having bearing panels 102 connected by adaptor panels 104 to fit the wearer 10. Harness system 100 is adapted for wearing on one or more of a hip, leg or chest of a wearer 10. It will be appreciated that elements of the system may be adapted or fitted to conform to other areas of the wearer as appropriate for a given situation. Each harness system 100 has one or more load bearing panels 102. Bearing panels 102 may themselves function as independent harness systems 100 for use on the hip, leg, chest (or other areas) of the wearer as needed. Bearing panels 102 preferably have a mono-layer construction composed of a light-weight, high-tensile strength, fire-retardant material such as Hypalon® or Trelleborg HANK® or bonded Cordura® substrates. It will be appreciated that the panels may be constructed from a variety of materials, such as, but not limited to carbon fibre, a light-weight metal such as aluminium, a plastic or plastic composite, and/or one or more polymers.

Each bearing panel 102 preferably has two or three (or more) connection loops extending vertically from the panel to permit connection to other panels or equipment as needed.

In a preferred configuration, the load bearing panels can form a platform having 4, 6, 8, 10, 12 and/or 14 Modular Lightweight Load-carrying Equipment (MOLLE) columns wide, and up to 5 (or more) rows high.

Figure 2:
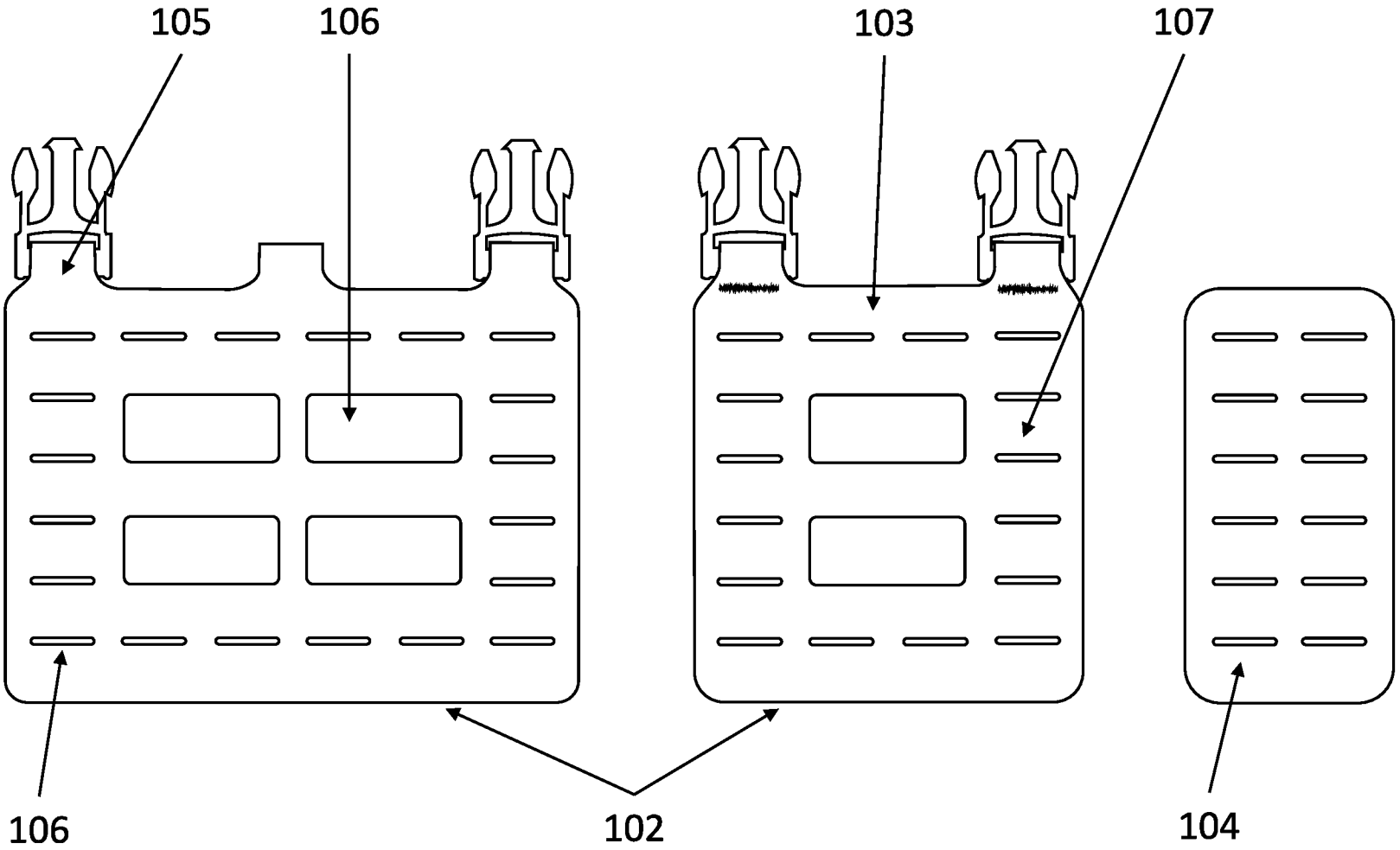
FIG. 2 shows differently sized and configured load bearing panels for use with the system of FIG. 1.

Referring to FIG. 2, harness system 100 has adaptor panels 104 adapted to connect with one or more bearing panels 102, to modify the size and configuration of the harness system. Each load bearing panel 102 preferably has a single, substantially non-deformable layer 103, a fastener 105, a plurality of first openings or apertures 108, a plurality of second openings or apertures 106 arranged to define horizontal and vertical bands 107, and a structural column configured to enable void space.

With continuing reference to FIG. 2, first openings 108 and second openings 106 each have a length and width, from a top view. The lengths of openings 108 and 106 parallel the length of panel 102. Preferably, first openings 108 are arrayed around second openings 106 so that at least one of first openings 108 separates one of second openings 106 from the perimeter in a plane along the width of panel 102. Each of second openings preferably has a dimension larger than a dimension of each first opening. For example, the length and width of each second opening 106 is larger than a corresponding length and width of each first opening 108, such as shown in FIG. 2. This arrangement beneficially facilitates flexible (e.g., vertical and lateral) movement of a fastening band such as band 114 shown in FIG. 4, and described below. The particular placement of a smaller first opening adjacent a larger second opening enhances fixed placement of the harness to the user, while placement of the larger second openings 106, preferably in a central region of panel 102, provides for the panel to be shifted within a confined space on the wearer for maximal comfort. Flexibility and comfort are important features in any harness envisioned for use in, or navigating challenging terrain and/or weather conditions.

The dimensions of the first and second openings may be varied as appropriate for a given situation, but preferably the second openings have an overall dimension substantially larger than that of the first openings. For example only, second openings 106 may have a length and width that is at least twice that of first openings 108, such as shown in FIG. 2.

Referring still to FIG. 2, adaptor panels 104 each preferably have a length equal to the width of the bearing panel, from a top view.

Figure 3:
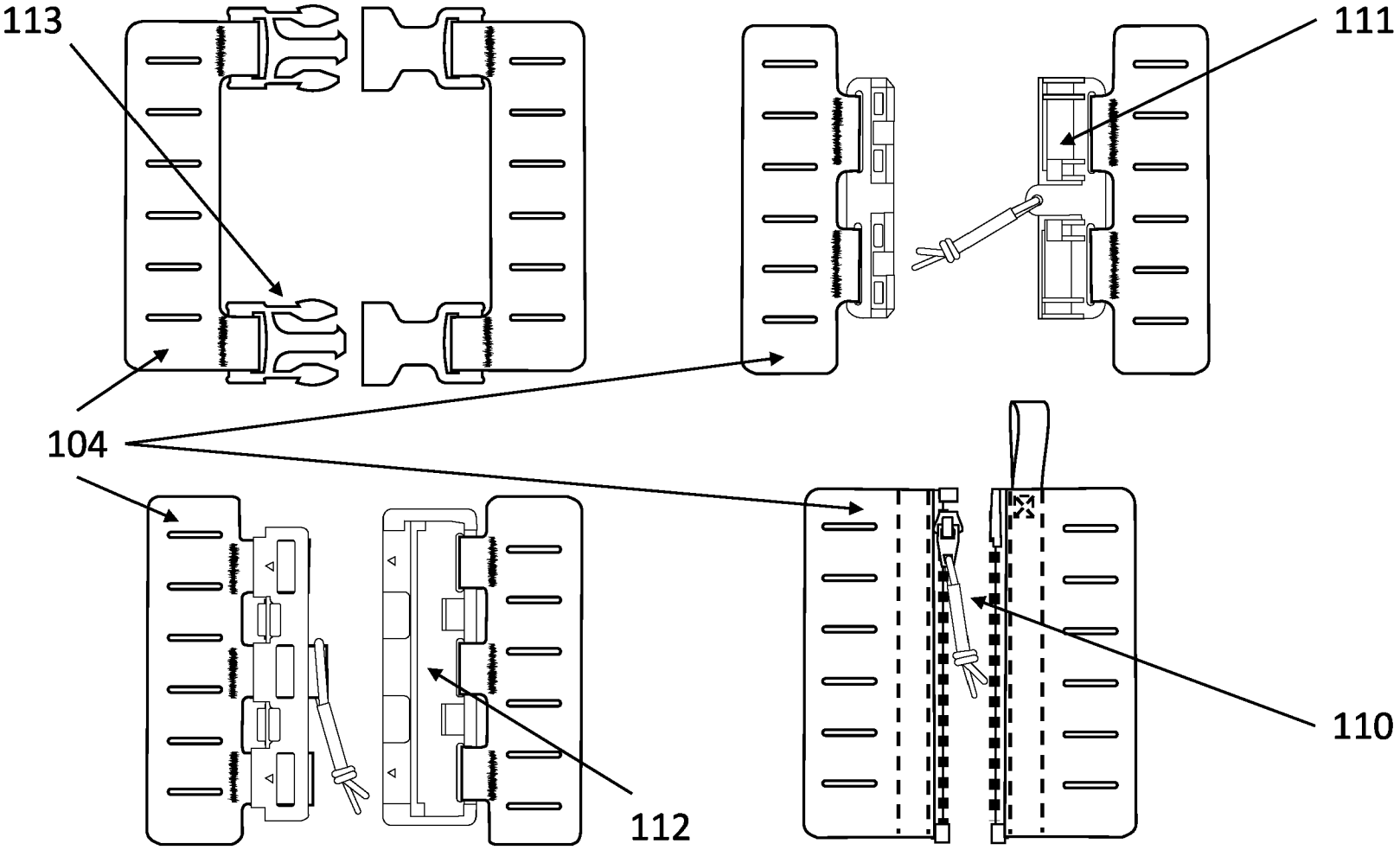
FIG. 3 shows various adaptor panels for use with the system of FIG. 1.

FIG. 3 shows adaptor panels 104, with fasteners shown in the form of a slide fastener 110, Tubes® 111, a locking structure such as a Fidlock® 112 and snap-fit clip 113 for connecting the adaptor panels to a corresponding fastener on load carrying equipment. Adaptor panels 104 provide a maximum strength connection between adaptor panels without adding bulk or thickness. The light-weight nature of the adaptor panels contribute to the weight reduction of the platform, by providing, for example only, an up to 42% void space on each load bearing panel.

Figure 4:
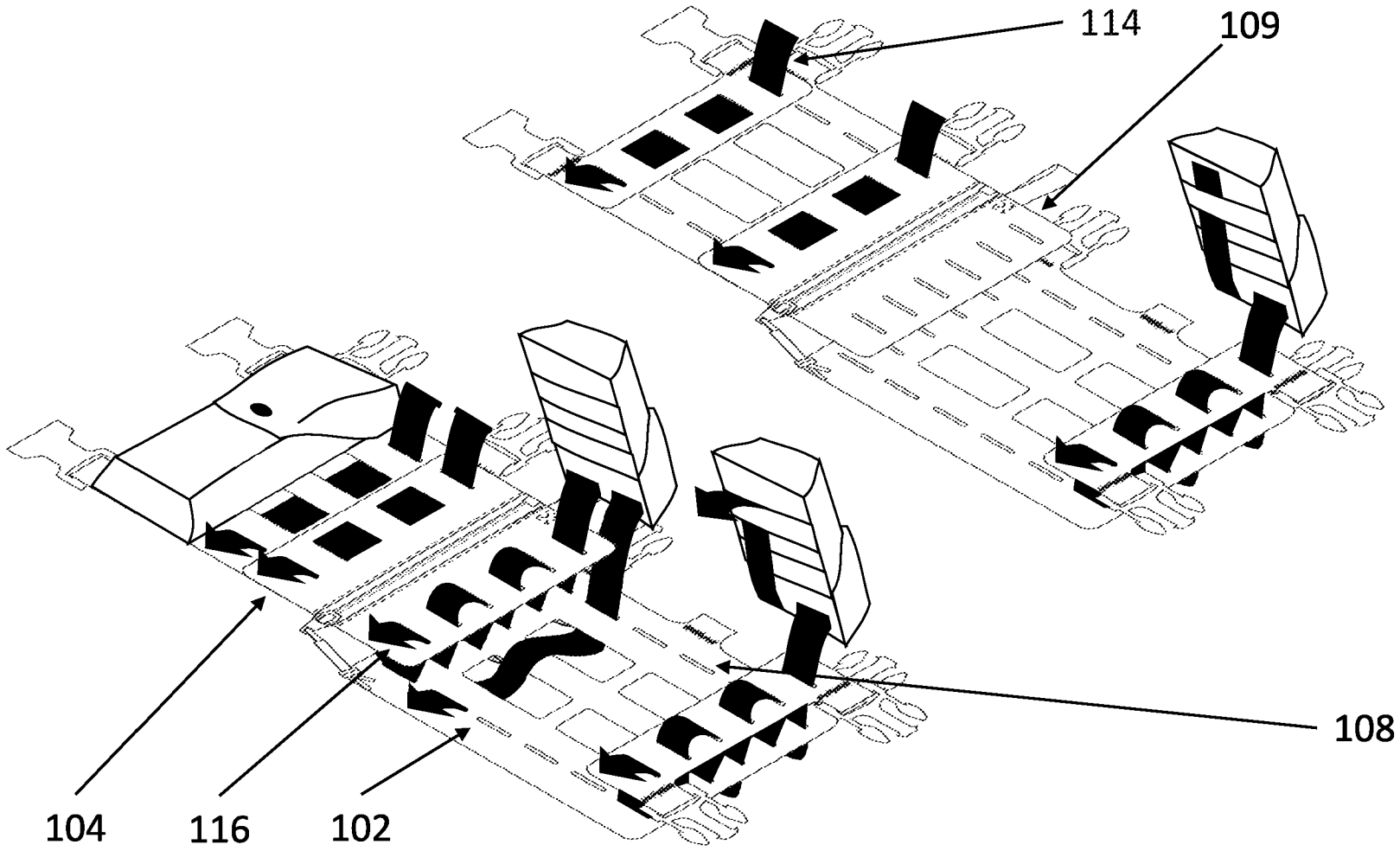
FIG. 4 shows the load bearing panels and adaptor panels of FIGS. 2 and 3 connected by weaving vertical bands between the pieces to connect them together in a secure yet flexible arrangement.

Referring now to FIG. 4, adaptor panel 104 is shown connected to bearing panel 102 by weaving of vertical bands 114 between panels 102 and 104. Vertical band 114 may be made from a flexible material such as a monolayer fabric, cloth or a durable plastic. Utilising the vertical bands from attached pouches to secure items together helps enable connectors to be customised to adapt to existing military-issued load carriage equipment without substantially adding weight to the system.

Continuing to refer to FIG. 4, adaptor panels 104 include a plurality of openings 109 arranged to engage with one or more of first openings 108 in bearing panels 102 and the load carriage equipment. Vertical bands 114 of the load carriage equipment can be weaved 116 through a column 109 of first openings 108 in the adaptor panels to attach the adaptor panels to the load carriage equipment. Vertical bands 114 may also be weaved 116 through first openings 108 in bearing panels 102 to attach the adaptor panels to the bearing panels.

It will be appreciated that in the system, a single, substantially non-deformable layer may be made from one or more of a lightweight, high tensile, and fire-retardant material. The material may be Hypalon® or Tellebourg HANK® or any other lightweight, high tensile or fire-retardant material.

It will be appreciated that in the system, the fastener of the load bearing panel may be a buckle, clip, tubes, slide fastener, clasp, magnet or loop, or other fastener, or any combination of these. In a preferred embodiment, a bearing panel may have two or three connection loops rising vertically above the bearing panel.

It will be further appreciated that the plurality of openings on the load bearing panels are interoperable with the vertical bands of load carriage equipment, including load carriage equipment with a conventional Pouch Attachment Ladder System (PALS) webbing system, such that the vertical bands can be weaved through the openings on the load bearing panels to attach the load bearing panels to the load carriage equipment.

It will be additionally appreciated that the structural column enables over 40% of the load bearing panels as void space. In one embodiment, the void space reduces the weight of the harness system.

It will be appreciated that in the system, the harness system is adapted for wearing on one or more of a hip, leg or chest of a user. However, the harness system may also be adapted for wearing on the arm, back, head or any other body part of a user. The harness system may also be adapted for connecting to a garment of a wearer or to packs or other load carriage or other military equipment. In a preferred embodiment, the harness system is compatible with Modular Lightweight Load-carrying Equipment (MOLLE) accessories.

It will be further appreciated that the harness system has adaptor panels adapted to connect with one or more bearing panels, to modify the size and configuration of the harness system to suit one or more of a body size of a wearer, position of wear, weight and configuration of load carriage equipment, and opening configuration of load carriage equipment. The harness system may be sized to fit the chest of a 5th percentile female to a 95th percentile male, based on Australian Defence Force Population anthropometry from DSTO-TR-3006 A Preliminary Anthropometry Standard for Australian Army Equipment Evaluation. In one embodiment, the harness system is compatible with MOLLE system load carriage equipment. In one embodiment, independently or in combination, load bearing panels may form harness systems of 4, 6, 8, 10, 12 and 14 MOLLE columns wide, and 5 rows high. The configuration may enable the harness system to be utilised with front opening load carriage configurations, side opening load carriage configurations and other options when used in combination.

It will also be appreciated that in the system, the adaptor panels have one or more of a buckle, clip, tubes, slide fastener, clasp, magnet, loop, or other fastener, or any combination of these, to connect the adaptor panels to the one or more bearing panels or to packs or load carriage equipment or other military equipment. In a preferred embodiment the adaptor panels may have military standard connectors like Fastex®, Tubes®, Zipper® and Fidlock® for connecting the adaptor panels to a ballistic plate carrier, load bearing harness or military compatible backpack.

The adaptor panels may include a plurality of openings arranged to engage with one or more of the openings on the bearing panels and the load carriage equipment. The openings on the adaptor panels may be interoperable with the vertical bands of load carriage equipment, such that the vertical bands can be weaved through the openings on the adaptor panels to attach the adaptor panels to the load carriage equipment. The vertical bands may also be weaved through the openings on the bearing panels to attach the adaptor panels to the bearing panels. This embodiment enables connection of the adaptor panels to one or more of the load carriage equipment and the bearing panels without adding any additional weight.

It will be appreciated that in the system, one or more of the load bearing panels and the adaptor panels may include a camouflage pattern to enhance undetectability of a wearer of the platform.

The foregoing description is by way of example only, and may be varied considerably without departing from the scope of the present disclosure. For example, in order to enhance comfort, a gel layer may be integrated with the harness. Any cloth layers may include a wicking layer to help perspiration wick away from the user. A microchip with GPS capability may be integrated within the harness to assist in user tracking and location in situations where user evacuation is needed in an emergency situation.

The present disclosure in a preferred form provides the advantages of being able to be configured to fit the size of different users, be used in connection with different body parts of a user, be used in connection with load carrying equipment of different weights and sizes and opening configurations, without additional weight due to the voids and the use of the vertical bands from the load carrying equipment to connect, by weaving, the components of the load harness system.

Other embodiments of the disclosure will be apparent to those skilled in the art from consideration of the specification and practice of forms of the embodiments disclosed herein. It is intended that the specification and examples be considered as exemplary only, with a true scope and spirit of the disclosure being indicated by the following claims.

What is claimed is:

1. A personal mobile load bearing platform comprised of a plurality of interlocked panels compatible with modular lightweight load-carrying equipment (MOLLE) system for carrying equipment, the system comprising:

a load-bearing panel, said bearing panel having an outer perimeter with an edge defining a length and a width, said load-bearing panel including a plurality of apertures of different sizes configured to receive and attach MOLLE accessories and/or other load bearing attachments, the apertures including:

a plurality of first vertical band receiving apertures having a length and a width forming a vertical structural column on each side of said bearing panel;

a plurality of second vertical band receiving apertures forming at least one intermediate structural column between said vertical structural columns, each of said second vertical band receiving apertures having a length and a width greater than the length and width of one of the first vertical band receiving apertures, the length of each of said second vertical band apertures being at least twice the length of one of the first vertical band receiving apertures, the lengths of said first and said second vertical band receiving apertures being generally parallel to the length of said bearing panel, at least one of said first apertures being positioned between a top of said edge and one of said second apertures, another of said first apertures being positioned between a bottom of said edge and one of said second apertures so that one or more of said second apertures are positioned in a central region of said bearing panel and are configured to accommodate greater vertical and lateral movement of a vertical band inserted through said first and said second apertures compared to vertical and lateral movement of the vertical band inserted through only said first apertures;

an adaptor panel having a plurality of said first apertures, said adaptor panel having a length equaling vertical structural column of said bearing panel so that said first apertures of said adaptor panel align with said first apertures of said vertical structural column of said bearing panel to allow a vertical band to interweave through said first apertures of each panel to interlock said adaptor panel to said bearing panel; and a plurality of fasteners, a first of said fasteners being configured for sliding engagement along a length of an edge of one of said panels, at least a second of said fasteners being differently configured compared to said first fastener.

2. The platform of claim 1, wherein said first fastener is a zipper.

3. The platform of claim 1, wherein said bearing panel includes multiple rows and columns of said second apertures, and said first apertures are arrayed around said second aperture.

4. The platform of claim 1, wherein two of said second apertures are positioned adjacent one another with none of said first apertures therebetween.

5. The platform of claim 1, wherein said second fastener is one or more of a buckle, clip, tubes, clasp, or magnet, or any combination of thereof.

6. The platform of claim 1, wherein said bearing panel includes a layer made from one or more of a lightweight, high tensile, and fire-retardant material.

7. The platform of claim 1, wherein the platform is adapted for wearing on one or more of a hip, leg or chest of a user.

8. The platform of claim 1, wherein the platform is adapted for wearing as an extension to packs or other load carriage equipment.

9. The platform of claim 1, wherein at least one of said panels include a camouflage pattern to enhance undetectability of a wearer of the platform.

10. The platform of claim 1, further comprising a fastening band made from a flexible material configured to interweave through at least said first apertures to connect said fastening band to at least said load-bearing panel.

11. The platform of claim 10, wherein the fastening band is made from at least one of a monolayer fabric, a cloth, bonded substrates or a durable plastic.

12. The platform of claim 1, wherein the combination of first and second apertures form an up to 42% void space of a total area of the load bearing platform.

13. The platform of claim 1, wherein the platform is compatible with Modular Lightweight Load-carrying Equipment accessories Pouch Attachment Ladder System accessories, or other load carriage equipment.

14. The platform of claim 1, wherein the load bearing platform is configured for use in a defense training or operational environments.

15. The platform of claim 1, wherein said platform, when fastened together, forms a structure of at least two panels overlapping one another and connected by the interwoven vertical band.

* * * * *